US011959363B2

(12) United States Patent
Trisal et al.

(10) Patent No.: US 11,959,363 B2
(45) Date of Patent: Apr. 16, 2024

(54) MULTILATERAL INTELLIGENT WELL COMPLETION METHODOLOGY AND SYSTEM

(71) Applicant: Schlumberger Technology Corporation, Sugar Land, TX (US)

(72) Inventors: Krishna Trisal, Yuzhno-Sakhalinsk (RU); Debasmita Basak, Pearland, TX (US); Kjell Revheim, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 22 days.

(21) Appl. No.: 17/760,009

(22) PCT Filed: Feb. 2, 2021

(86) PCT No.: PCT/US2021/016168
§ 371 (c)(1),
(2) Date: Aug. 3, 2022

(87) PCT Pub. No.: WO2021/158519
PCT Pub. Date: Aug. 12, 2021

(65) Prior Publication Data

US 2023/0066633 A1 Mar. 2, 2023

Related U.S. Application Data

(60) Provisional application No. 62/969,502, filed on Feb. 3, 2020.

(51) Int. Cl.
*E21B 41/00* (2006.01)
*E21B 43/08* (2006.01)

(52) U.S. Cl.
CPC ..... *E21B 41/0035* (2013.01); *E21B 43/08* (2013.01)

(58) Field of Classification Search
CPC .. E21B 41/0035; E21B 41/0042; E21B 43/08; E21B 43/14; E21B 17/028; E21B 17/18
See application file for complete search history.

(56) References Cited

U.S. PATENT DOCUMENTS 6,047,774 A * 4/2000 Allen ..... E21B 43/10 166/50
2003/0221834 A1 12/2003 Hess et al.
(Continued)

FOREIGN PATENT DOCUMENTS

WO 2017213726 A2 12/2017
WO WO-2017213726 A2 * 12/2017 ..... E21B 17/02

OTHER PUBLICATIONS

International Search Report and Written Opinion issued in PCT Application PCT/US2021/016168, dated May 24, 2021 (15 pages).

*Primary Examiner* — Tara Schimpf
*Assistant Examiner* — Jennifer A Railey
(74) *Attorney, Agent, or Firm* — Jeffrey D. Frantz

(57) ABSTRACT

A technique facilitates improving a completion architecture for a multilateral intelligent well completion (IWC). Effectively, a new and enhanced completion design and deployment approach is provided for multilateral IWCs. According to an embodiment, lower completion equipment is initially deployed downhole into a lower lateral borehole and lower section of a primary borehole. An intermediate completion may then be run downhole and into engagement with the lower completion equipment. Subsequently, an upper lateral borehole (or boreholes) may be drilled and completed. After drilling and completing the one or more upper lateral boreholes, an upper completion is deployed downhole and coupled with the intermediate completion in a manner which enables signal communication with downhole sections of the well.

20 Claims, 2 Drawing Sheets

(56) References Cited

U.S. PATENT DOCUMENTS

| | | | | |
|---|---|---|---|---|
| 2005/0045329 | A1 | 3/2005 | Wetzel et al. | |
| 2010/0314109 | A1* | 12/2010 | Garcia | E21B 43/04 166/278 |
| 2011/0011580 | A1* | 1/2011 | Clark | E21B 33/124 166/66.5 |
| 2013/0075087 | A1* | 3/2013 | Algeroy | E21B 23/00 166/250.01 |
| 2016/0047176 | A1 | 2/2016 | Martin | |
| 2017/0234113 | A1* | 8/2017 | Steele | E21B 47/12 166/381 |
| 2017/0241241 | A1* | 8/2017 | Pendleton | E21B 47/10 |
| 2018/0348389 | A1* | 12/2018 | Jaaskelainen | E21B 47/107 |

* cited by examiner

MULTILATERAL INTELLIGENT WELL COMPLETION METHODOLOGY AND SYSTEM

CROSS-REFERENCE TO RELATED APPLICATION

This application is the National Stage Entry of International Application No. PCT/US2021/016168, filed Feb. 2, 2021, which claims priority to U.S. Provisional Patent Application Ser. No. 62/969,502, filed Feb. 3, 2020, which is incorporated herein by reference in its entirety.

BACKGROUND

In many well applications, a primary borehole is drilled into a subterranean formation and lateral boreholes are drilled so as to extend laterally from the primary borehole. The lateral boreholes and primary borehole may then be completed with appropriate completion equipment. However, complications arise in providing independent monitoring and control of flow from the lateral boreholes and the primary borehole. For example, downhole flow control valves, permanent downhole gauges, downhole cables, and control lines are run through multilateral junctions with very little clearance and this increases the potential for damage to such components. Sometimes, smaller sized completion tubing is run downstream of the uppermost multilateral junction interface but this can limit the maximum production rate. Running smaller sized completion tubing also can create buckling issues during deployment and/or during the life of the well.

SUMMARY

In general, a methodology and system are provided for improving a completion architecture for a multilateral intelligent well completion (IWC). Effectively, a new and enhanced completion design and deployment approach is provided for multilateral IWCs. According to an embodiment, lower completion equipment is initially deployed downhole into a lower lateral borehole and lower section of a primary borehole. An intermediate completion may then be run downhole and into engagement with the lower completion equipment. Subsequently, an upper lateral borehole (or boreholes) may be drilled and completed. After drilling and completing the one or more upper lateral boreholes, an upper completion is deployed downhole and coupled with the intermediate completion in a manner which enables electrical and/or hydraulic communication with downhole sections of the well.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a methodology and system for improving a completion architecture in a manner which benefits the construction and utilization of a multilateral intelligent well completion. According to an embodiment, lower completion equipment is initially deployed downhole into a lower lateral borehole and lower section of a primary borehole. An intermediate completion may then be run downhole and into engagement with the lower completion equipment. In some embodiments, the intermediate completion may comprise a lower coupler portion, e.g. a wet mate coupler portion, which stabs into a corresponding coupler portion in the lower completion equipment. Subsequently, an upper lateral borehole may be drilled and completed. After drilling and completing the one or more upper lateral boreholes, an upper completion is deployed downhole and coupled with the intermediate completion in a manner which enables electrical and/or hydraulic communication with downhole sections of the well.

It should be noted that the well system may have multiple upper lateral boreholes, and multiple intermediate completions may be run downhole and into engagement with lower completion equipment. In the case of additional upper lateral boreholes, the lower completion equipment may comprise the previously deployed, lower intermediate completion. The methodology for constructing a multilateral IWC, as described herein, facilitates deployment of intelligent completion devices, including flow control valves, permanent downhole gauges, downhole cables, and control lines into and through, for example, multilateral junctions with less risk of component damage.

Additionally, the methodology can facilitate use of larger size completion tubing to help maximize production, prevent buckling issues, and otherwise facilitate well operation. Effectively, the completion tubing can remain of a larger size because there is no requirement that swell packers, flow control valves, and permanent downhole gauges be run through the junctions. The methodology also enables rig time savings because there is no need to perform wellbore cleanout runs past lower lateral junctions prior to running the upper completion.

Figure 1:
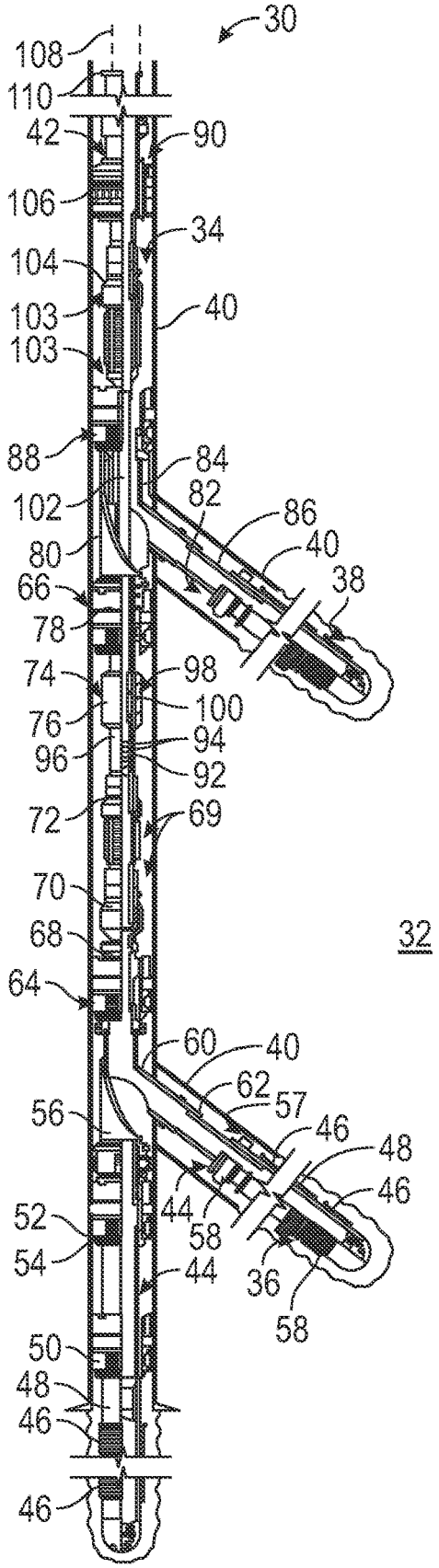
FIG. 1 is an illustration of an example of a multilateral intelligent well completion deployed in a multilateral well, according to an embodiment of the disclosure.

Referring generally to FIG. 1, an example of a well system 30 is illustrated for use in producing a well fluid, e.g. oil, from a subterranean formation 32. In this example, the well system 30 comprises a primary borehole 34 and a plurality of lateral boreholes 36, 38 extending laterally from the primary borehole 34. In FIG. 1, two lateral boreholes 36, 38 are illustrated to facilitate explanation. However, some implementations may utilize additional lateral boreholes extending from the primary borehole 34. The primary borehole 34 and the lateral boreholes 36, 38 may be lined with suitable casing 40.

According to the illustrated example, the lateral boreholes comprise lower lateral borehole 36 and upper lateral borehole 38 although additional upper lateral boreholes 38 may be used in a given well system 30. It should further be noted that in some well applications, the primary borehole 34 may be a deviated borehole. Accordingly, the lower lateral borehole 36 refers to the lateral borehole located farther downhole and the upper lateral borehole 38 refers to a lateral borehole positioned uphole relative to the lower lateral borehole 36.

The well system 30 further comprises a multilateral intelligent well completion 42 deployed in the primary borehole 34 and the lateral boreholes 36, 38. By way of example, the completion 42 may comprise lower completion equipment 44 deployed into the lower lateral borehole 36 and into a lower portion of the primary borehole 34. Additionally, the lower completion equipment 44 deployed into the lower portion of primary borehole 34 may comprise a variety of equipment, such as a plurality of completion assemblies 46, e.g. sand screen assemblies, positioned along tubing 48 and sometimes separated by packers. It should be noted the completion assemblies 46 are illustrated as sand screen assemblies but a variety of other completion assemblies may be utilized, e.g. slotted pipe, perforated liners, or cemented perforator liners. The lower completion equipment 44 also may comprise a primary borehole lower completion sealing device 50, e.g. a packer; an additional sealing device 52, e.g. a packer, combined with a fluid loss device 54; and a deflection device 56. In the illustrated example, sealing devices 50, 52 are illustrated as packers which may be used for sealing, anchoring, and/or orienting. However, devices 50, 52 may comprise a variety of other types of sealing devices having the desired sealing, anchoring, and/or orienting functionality.

The deflection device 56 may be used to facilitate deployment of lower completion equipment 44 into lower lateral borehole 36. Deflection device 56 may comprise a variety of types of devices, e.g. a completion deflector. By way of example, the completion equipment deployed into lower lateral borehole 36 may comprise a lower lateral completion string 57 having a plurality of completion assemblies 46, e.g. sand screen assemblies or other suitable assemblies, positioned along tubing 48 and separated by a plurality of isolation devices 58, e.g. isolation packers.

The lower lateral borehole 36 may be placed in fluid communication with the primary borehole 34 via, for example, a lower multilateral junction 60 coupled with a tieback receptacle 62 located in the lower lateral borehole 36. The lower multilateral junction 60 extends into the primary borehole 34 and up into engagement with a corresponding packer 64 located above lower lateral borehole 36. Accordingly, packer 52 is positioned below lower lateral borehole 36 and corresponding packer 64 is positioned above lower lateral borehole 36. As noted above, the sealing device 52 is illustrated and described as a packer for purposes of explanation, however a variety of other types of sealing devices may be employed with the desired sealing, anchoring, and/or orienting functionality.

In the embodiment illustrated, the multilateral intelligent well completion 42 further comprises an intermediate completion 66 which may be run downhole into primary borehole 34 and moved into engagement with the lower completion equipment 44. For example, the intermediate completion 66 may comprise an intermediate completion coupling junction 68 having seals which are received in a sealing engagement with corresponding packer 64 (or other suitable annulus isolation device) of lower completion equipment 44.

Additionally, the intermediate completion 66 may comprise various other components including permanent downhole monitoring and flow control equipment 69 for both the primary borehole 34 and the lower lateral borehole 36. By way of example, the equipment 69 may comprise various sensors for obtaining downhole measurements, e.g. pressure measurements, temperature measurements, flowrate measurements, water cut measurements, gas cut measurements, and/or other downhole data.

Additionally, the equipment 69 may comprise an intermediate completion inline flow control valve 70. The flow control valve 70 may be used to control fluid flow from the primary borehole 34 as it moves through the intermediate completion 66. By way of further example, the intermediate completion 66 may comprise an intermediate completion annulus flow control valve 72. The flow control valve 72 may be used to control fluid flow received into intermediate completion 66 from the lower lateral borehole 36.

The intermediate completion 66 also may comprise a control line coupler 74 through which control/data signals may be sent downhole and/or uphole to the various sensors, flow control valves 70, 72, and/or various other intelligent completion equipment. The control/data signals may be electrical signals, hydraulic signals, hydroelectric signals, optical signals, and/or other suitable signals for enabling control over downhole components and collection of data from downhole sensors. By way of example, the control line coupler 74 may be in the form of a female wet mate coupler 76 having, for example, hydraulic, hydroelectric, electric, and/or fiber optic connectors. With respect to electrical signals, the control line coupler 74 may comprise an inductive coupler for transmitting the electrical signals without a physical conductive connection. In the example illustrated, the intermediate completion 66 further comprises an intermediate completion sealing device 78, e.g. a packer, which may be deployed to a position on the downhole side of upper lateral borehole 38. In the illustrated example, sealing device 78 is illustrated as a packer which may be used for sealing, anchoring, and/or orienting. However, device 78 may comprise a variety of other types of sealing devices having the desired sealing, anchoring, and/or orienting functionality.

In some embodiments, the intelligent well completion 42 also may comprise an upper lateral deflection device 80 which may be coupled with intermediate completion packer 78. The deflection device 80 may be used to facilitate deployment of an upper lateral completion string 82 into upper lateral borehole 38. Depending on the parameters of a given operation, deflection device 80 may comprise a variety of types of devices, e.g. a completion deflector. By way of further example, the upper lateral completion string 82 may comprise a plurality of the completion assemblies 46, e.g. sand screen assemblies, positioned along tubing 48 and separated by a plurality of the isolation packers 58 (or other suitable isolation devices). It should be noted that once again the completion assemblies 46 are illustrated as sand screen assemblies but a variety of other completion assemblies may be utilized, e.g. slotted pipe, perforated liners, or cemented perforator liners.

The upper lateral borehole 38 may be placed in fluid communication with the primary borehole 34 via, for example, an upper multilateral junction 84 coupled with a tieback receptacle 86 located in the lateral borehole 38. The upper multilateral junction 84 extends into the primary borehole 34 and up into engagement with a corresponding isolation device 88 located above upper lateral borehole 38. Isolation device 88 may be in the form of a packer (as illustrated) or other suitable sealing device with desired sealing, anchoring, and/or orienting functionality. The corresponding packer 88 may be mounted on or connected with the upper lateral deflection device 80. Accordingly, the intermediate completion packer 78 (or other suitable device with the desired sealing, anchoring, and/or orienting functionality) is positioned below upper lateral borehole 38 and the corresponding packer 88 is positioned above upper lateral borehole 38. It should be noted that intermediate completion packer 78, in addition to isolating along the primary borehole 34, may be used as an anchoring and/or orienting device for the deflection device 80, at least part of the multilateral junction 84, and/or a whipstock. The whipstock may be oriented to facilitate milling/drilling of desired lateral borehole(s), e.g. upper lateral borehole 38. Additionally, other types of sealing/anchoring/orienting devices may be used instead of intermediate completion packer 78. Examples of other types of devices (instead of packer 78) for sealing, anchoring, and/or orienting include a lock and latch coupling or other suitable device.

As further illustrated in FIG. 1, the multilateral intelligent well completion 42 also may comprise an upper completion 90 which may be conveyed downhole and installed into engagement with the intermediate completion 66. By way of example, the upper completion 90 may comprise an upper completion seal assembly and latch system 92 which is sealingly received by intermediate completion 66 and latched thereto. In some embodiments, the upper completion seal assembly and latch system 92 comprises a plurality of seals 94 which are received in a corresponding tubing 96, e.g. a polished bore receptacle, of intermediate completion 66. The seals 94 press against the inside surface of tubing 96 to form the desired seal between the intermediate completion 66 and the upper completion 90.

The upper completion 90 also may comprise an upper completion control line coupler 98, e.g. a male wet mate coupler 100, received by control line coupler 74/female wet mate coupler 76 of intermediate completion 66. Once the upper completion control line coupler 98 is received by the intermediate completion control line coupler 74, appropriate control/data signals may be communicated along the overall intelligent well completion 42. According to the illustrated example, the upper completion control line coupler 98 is delivered downhole via a stinger 102 which is able to move the seal assembly/latch system 92 and coupler 98 down through packer 88 and packer 78.

The stinger 102 may extend up into engagement with other upper completion components, such as permanent downhole monitoring and flow control equipment 103. The equipment 103 may comprise various sensors for obtaining downhole measurements, e.g. pressure measurements, temperature measurements, flowrate measurements, water cut measurements, gas cut measurements, and/or other downhole data. Additionally, the equipment 103 may comprise an upper completion annulus flow control valve 104. The flow control valve 104 may be used to control fluid flow received from the upper lateral completion string 82 located in the upper lateral borehole 38. The upper completion 90 also may comprise an upper completion production packer 106 positioned, for example, above the flow control valve 104. The use of wet mate style couplers 76, 100 reduces cost, time and complexity for workovers as it allows quick and easy change out of completion tubing above the production packer 106. There is no need to retrieve and change out permanent monitoring and flow control equipment.

In some embodiments, a pre-stabbed stinger 108 and receptacle 110 may be installed above the upper completion production packer 106 to provide another wet mate system and to facilitate workovers. The pre-stabbed stinger 108 and receptacle 110 enable retrieval of the upper completion 90 by applying tension from the surface (as opposed to running a wireline/slick line and cutter to form an appropriate cut for releasing the upper completion production packer 106 before retrieving the upper completion 90). This improved approach can save substantial rig time and reduce cost.

In an operational example the multilateral intelligent well completion 42 is constructed by initially deploying lower completion equipment 44 into the lower portion of primary borehole 34 and into lower lateral borehole 36. In some applications, the primary borehole 34 may initially be drilled and cased so as to receive corresponding components of the lower completion equipment 44. The lower lateral borehole 36 can then be drilled and cased for receipt of corresponding components of the lower completion equipment 44, e.g. lower completion string 57. Deploying the lower completion equipment 44 also may comprise forming suitable connections between the primary borehole 34 and the lower lateral borehole 36 via, for example, lower multilateral junction 60, tieback receptacle 62, and corresponding packer/isolation device 64.

Once the lower completion equipment 44 is deployed, the intermediate completion 66 may be run downhole and into engagement with the lower completion equipment via, for example, sealed coupling with corresponding packer 64. Depending on the parameters of the operation, the intermediate completion 66 may be run on its own in a separate trip downhole or combined with the upper lateral deflection device 80, at least part of the upper multilateral junction 84, and/or a whipstock to facilitate milling/drilling of the upper lateral borehole 38. After running the intermediate completion 66 downhole, the upper lateral borehole 38 may be drilled and cased with casing 40. The procedure may vary according to the parameters of a given operation, but the upper lateral deflection device 80 may be connected with the intermediate completion 66 at a suitable time to facilitate deployment of the upper lateral completion string 82 into the upper lateral borehole 38. Deploying the upper lateral completion string 82 also may comprise forming suitable connections between the primary borehole 34 and the upper lateral borehole 38 via, for example, upper multilateral junction 84, tieback receptacle 86, and corresponding packer 88.

After using the upper multilateral junction 84 to place the upper lateral borehole 38 in fluid communication with the primary borehole 34, the upper completion 90 may be installed. By way of example, the upper completion 90 may be installed by conveying the upper completion 90 downhole and into engagement with the intermediate completion 66. As explained above, the upper completion 90 may be engaged with intermediate completion 66 via upper completion seal assembly/latch system 92 and control line coupler 98. For example, male wet mate coupler 100 of upper completion 90 may be engaged with female wet mate coupler 76 of intermediate completion 66 to enable communication therethrough of desired signals, e.g. electrical, hydraulic, electrohydraulic, and/or optical signals.

Figure 2:
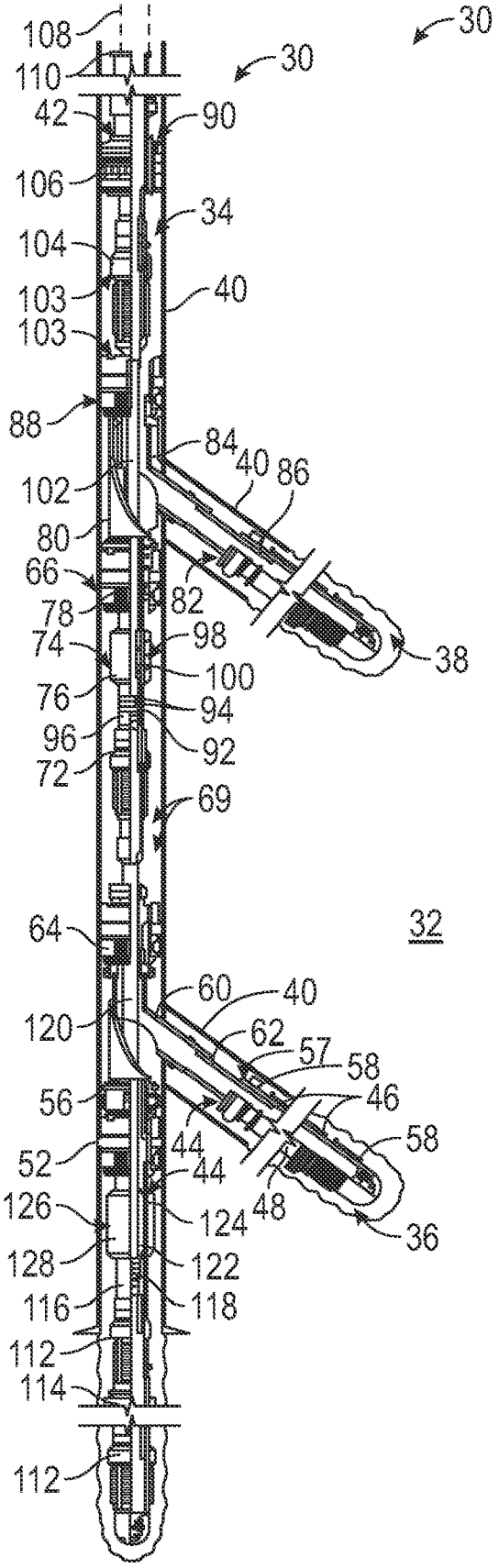
FIG. 2 is an illustration of another example of a multilateral intelligent well completion deployed in a multilateral well, according to an embodiment of the disclosure.

Referring generally to FIG. 2, another embodiment of the multilateral intelligent well completion 42 is illustrated. This embodiment may be used to further segment the primary borehole 34 via a plurality of control line couplers similar to coupler 74/98. According to an embodiment, two separate control line couplers may be utilized along the primary borehole 34 with one positioned below the lower multilateral junction 60 and one below the upper multilateral junction 84 as illustrated.

In this example, the lower completion equipment 44 may comprise a plurality of flow control valves 112 which can be controlled to provide sub-zonal flow control along the primary borehole 34. The sub-zones may be isolated using corresponding packers 114 (or other suitable annulus isolation devices). The lower completion equipment 44 also may comprise a tubular component 116, e.g. a polished bore receptacle, to receive a lower completion seal assembly and latch system 118 of intermediate completion 66. In this embodiment, the lower completion seal assembly and latch system 118 may be connected into intermediate completion 66 via a stinger 120. The lower completion seal assembly and latch system 118 is sealingly received by tubular component 116 of lower completion equipment 44 and latched thereto when intermediate completion 66 is deployed downhole.

In this embodiment, the intermediate completion 66 may comprise an intermediate completion control line coupler 122, e.g. a male wet mate coupler 124, received by a corresponding control line coupler 126/female wet mate coupler 128 appropriately located in lower completion equipment 44 above flow control valves 112. Once the completion control line coupler 122 is received by the corresponding completion control line coupler 126, appropriate control/data signals may be communicated along the lower portion of intelligent well completion 42.

According to the illustrated example, the completion control line coupler 122 attached to intermediate completion 66 is delivered downhole via the stinger 120 which is able to move the seal assembly/latch system 118 and coupler 122 down into engagement with tubular component 116 and the corresponding control line coupler 126, respectively. In some embodiments, the intermediate completion packer 78 (or other suitable isolation device) may comprise an orienting profile and suitable anchors. According to the embodiment illustrated in FIG. 2, the additional control line coupler 126/122 (or multiple additional couplers) may be employed to facilitate coupling and decoupling of control lines along which may be carried the control/data signals, e.g. electric signals, hydraulic signals, electrohydraulic signals, fiber-optic signals, or other suitable signals for controlling downhole components and/or obtaining downhole data.

Depending on the parameters of a given well application, the overall intelligent well completion 42 may comprise a variety of other and/or additional components. Furthermore, some applications may utilize additional upper lateral boreholes 38 by sequentially deploying additional intermediate completions 66 and subsequently drilling and completing each of the additional upper lateral boreholes 38. Furthermore, a variety of wet mate couplers or other couplers may be used to connect the upper completion 90 with the intermediate completion 66 (and/or the intermediate completion 66 with lower completion equipment 44) to accommodate desired electrical signals, hydraulic signals, hydroelectric signals, optical signals, and/or other signals sent downhole and/or uphole for the purpose of control and/or monitoring. The types of isolation devices, valves, sand screen assemblies, flow control devices, and other components and features may be selected according to the parameters of a given operation. For example, various sealing/isolation devices may be in the form of packers or other suitable devices having the desired sealing, anchoring, and/or orienting capability. Additionally, the completion strings deployed into the lateral boreholes may comprise various types of sand screens or other filtering devices in combination with various types of sealing devices.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for completing a well, comprising:

deploying lower completion equipment into a lower lateral borehole and into a lower portion of a primary borehole from which the lower lateral borehole extends, wherein deploying the lower completion equipment comprises deploying a first packer positioned in the primary borehole below the lower lateral borehole and a second packer positioned in the primary borehole above the lower lateral borehole, and at least a portion of the primary borehole extends below at least a portion of the lower lateral borehole;

running an intermediate completion, having permanent downhole monitoring and flow control equipment for the lower lateral borehole and the primary borehole, downhole into engagement with the lower completion equipment;

after running the intermediate completion downhole, drilling an upper lateral borehole;

completing the upper lateral borehole;

using an upper multilateral junction to place the upper lateral borehole in fluid communication with the primary borehole; and installing an upper completion by conveying the upper completion downhole and into engagement with the intermediate completion to enable transmission of signals between the upper completion and the intermediate completion.

2. The method as recited in claim 1, wherein installing the upper completion comprises installing a production packer.

3. The method as recited in claim 2, wherein installing the upper completion comprises installing permanent downhole monitoring and flow control equipment.

4. The method as recited in claim 2, further comprising connecting a pre-stabbed stinger and receptacle to the upper completion above the production packer.

5. The method as recited in claim 1, wherein deploying the lower completion equipment comprises deploying a plurality of packers distributed between the lower lateral borehole and into the lower portion of the primary borehole, wherein the plurality of packers comprises the first packer and the second packer.

6. The method as recited in claim 5, wherein deploying the lower completion equipment comprises deploying a plurality of sand screen assemblies into the lower lateral borehole.

7. The method as recited in claim 6, wherein deploying comprises connecting the lower lateral borehole and the lower portion of the primary borehole via a lower multilateral junction connected to a lower tieback receptacle.

8. The method as recited in claim 1, wherein completing the upper lateral borehole comprises positioning a plurality of packers and a plurality of sand screen assemblies in the upper lateral borehole.

9. The method as recited in claim 8, wherein using the upper multilateral junction comprises connecting the upper multilateral junction with a tieback receptacle.

10. The method as recited in claim 1, wherein running the intermediate completion downhole comprises running an intermediate completion packer and a female wet mate coupler having at least one of hydraulic and electric coupling capability, the female wet mate coupler being positioned to receive an upper completion male wet mate coupler when installing the upper completion.

11. The method as recited in claim 10, wherein deploying the lower completion equipment comprises running a lower female wet mate coupler having at least one of hydraulic and electric coupling capability, the lower female wet mate coupler being positioned to receive a corresponding lower completion male wet mate coupler when installing the intermediate completion.

12. A method, comprising:

deploying lower completion equipment into a lower lateral borehole and into a lower portion of a primary borehole from which the lower lateral borehole extends, wherein deploying the lower completion equipment comprises deploying a first packer positioned in the primary borehole below the lower lateral borehole and a second packer positioned in the primary borehole above the lower lateral borehole, and at least a portion of the primary borehole extends below at least a portion of the lower lateral borehole;

running an intermediate completion downhole to provide permanent downhole monitoring and flow control with respect to the primary borehole and the lower lateral borehole extending from the primary borehole;

subsequently drilling and completing an upper lateral borehole; and conveying an upper completion downhole and into communication with the intermediate completion via a wet mate coupler having signal communication capability.

13. The method as recited in claim 12, wherein conveying the upper completion comprises installing a production packer.

14. The method as recited in claim 13, wherein conveying the upper completion comprises installing permanent downhole monitoring and flow control equipment.

15. The method as recited in claim 14, further comprising connecting a pre-stabbed stinger and receptacle to the upper completion above the production packer.

16. The method as recited in claim 12, wherein running the intermediate completion comprises using the wet mate coupler to form an inductive coupling between the upper completion and the intermediate completion.

17. The method as recited in claim 12, wherein running the intermediate completion comprises providing wet mate coupling capability at a plurality of locations along the primary borehole.

18. A system, comprising:

a multilateral well completion comprising:

lower completion equipment deployed into a lower lateral borehole and into a lower portion of a primary borehole, wherein the lower completion equipment comprises a first packer positioned in the primary borehole and below the lower lateral borehole and a second packer positioned in the primary borehole and above the lower lateral borehole, and at least a portion of the primary borehole extends below at least a portion of the lower lateral borehole;

an intermediate completion deployed downhole into engagement with the lower completion equipment via the second packer, the intermediate completion having permanent downhole monitoring and flow control equipment, an intermediate completion female wet mate coupler, and an intermediate completion packer;

a deflector to facilitate subsequent formation and completion of an upper lateral borehole; and an upper completion subsequently installed into the primary borehole and into communicative engagement with the intermediate completion via an upper completion male wet mate coupler.

19. The system as recited in claim 18, wherein a lower sand screen assembly string is positioned in the lower lateral borehole and placed in communication with the primary borehole via a lower junction and a tieback receptacle.

20. The system as recited in claim 19, wherein an upper sand screen assembly string is positioned in the upper lateral borehole and placed in communication with the primary borehole via an upper junction and a tieback receptacle.

* * * * *